US011141637B2

(12) United States Patent
Yasunaka et al.

(10) Patent No.: US 11,141,637 B2
(45) Date of Patent: Oct. 12, 2021

(54) GOLF HOLE CUP WITH GOLF BALL EJECTION DEVICE

(71) Applicant: FIFTYFIVE CO., LTD., Osaka (JP)

(72) Inventors: Takeshi Yasunaka, Osaka (JP); Toshiko Yasunaka, Higashiosaka (JP)

(73) Assignee: FIFTYFIVE CO., LTD., Osaka (JP)

( * ) Notice: Subject to any disclaimer, the term of this patent is extended or adjusted under 35 U.S.C. 154(b) by 0 days.

(21) Appl. No.: 15/734,926

(22) PCT Filed: Apr. 3, 2020

(86) PCT No.: PCT/JP2020/015289

§ 371 (c)(1),
(2) Date: Dec. 3, 2020

(87) PCT Pub. No.: WO2020/213429

PCT Pub. Date: Oct. 22, 2020

(65) Prior Publication Data

US 2021/0228953 A1 Jul. 29, 2021

(30) Foreign Application Priority Data

Apr. 15, 2019 (JP) ..... JP2019-077316

(51) Int. Cl.
*A63B 57/00* (2015.01)
*A63B 57/40* (2015.01)

(52) U.S. Cl.
CPC ..... *A63B 57/405* (2015.10)

(58) Field of Classification Search
CPC ..... A63B 57/405
(Continued)

(56) References Cited

U.S. PATENT DOCUMENTS 1,462,026 A 1/1922 Waddell
1,673,852 A * 6/1928 Underwood ..... A63B 57/405 473/177

(Continued)

FOREIGN PATENT DOCUMENTS

JP 8-141123 A 6/1996

OTHER PUBLICATIONS

International Search Opinion for the present PCT-US application No. PCT/JP2020/015289.

(Continued)

*Primary Examiner* — Nini F Legesse
(74) *Attorney, Agent, or Firm* — Stein IP, LLC

(57) ABSTRACT

A golf hole cup with a golf ball ejection device includes; a golf hole cup; a movable part accommodated in the cup, the movable part allowing a flagstick ferrule to be inserted therein and removed therefrom, and the movable part being movable vertically with the flagstick left inserted therein; a guide part that guides the movable part vertically; an elastic body that is at a bottom of the movable part, and exerts force to make the movable part having been pushed down return to an original position; a drive unit; a transmission part that is connected to the movable part and transmits downward acting force to the drive unit, the drive unit converting the downward acting force into upward acting force; an elevation part that is elevated upon receiving force from the drive unit; and a bottom plate part that is connected to and is elevated with the elevation part.

11 Claims, 12 Drawing Sheets

(58) Field of Classification Search
USPC ..... 473/173, 174, 175, 176, 178, 179
See application file for complete search history.

(56) References Cited

U.S. PATENT DOCUMENTS

| | | | | | |
|---|---|---|---|---|---|
| 3,874,665 | A * | 4/1975 | McCulloch | A63B 57/405 | 473/178 |
| 5,393,053 | A * | 2/1995 | Wiese | A63B 57/405 | 473/177 |
| 8,317,633 | B2 * | 11/2012 | Maclean | A63B 57/357 | 473/177 |
| 8,740,716 | B1 | 6/2014 | Mallonee | 473/177 | |
| 10,471,309 | B2 * | 11/2019 | Kosai | A63B 57/405 | |
| 2018/0207496 | A1 | 7/2018 | Zeidan | 57/405 | |

OTHER PUBLICATIONS

Notice of Reasons for Refusal issued by Japan Patent Office for the priority application (JP2019-077316) of the present PCT-US application No. PCT/JP2020/015289.
Notice of Allowance issued by Japan Patent Office for the priority application (JP2019-077316) of the present PCT-US application No. PCT/JP2020/015289.
Australian Examination Report dated Jun. 11, 2021, issued to corresponding Australian Application No. 2020257679.
Australian Notice of Acceptance dated Aug. 2, 2021, issued to the corresponding Australian Application No. 2020257679.

* cited by examiner

Fig. 4A
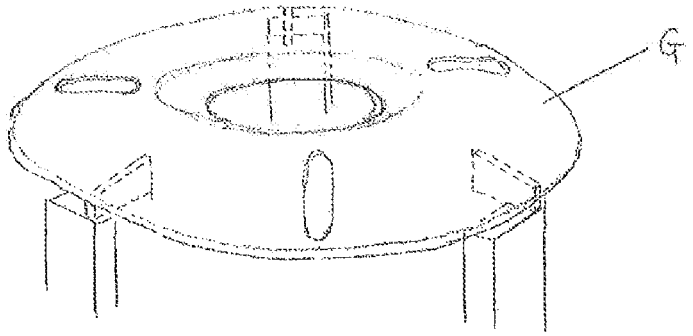
Fig. 4B
Fig. 4C
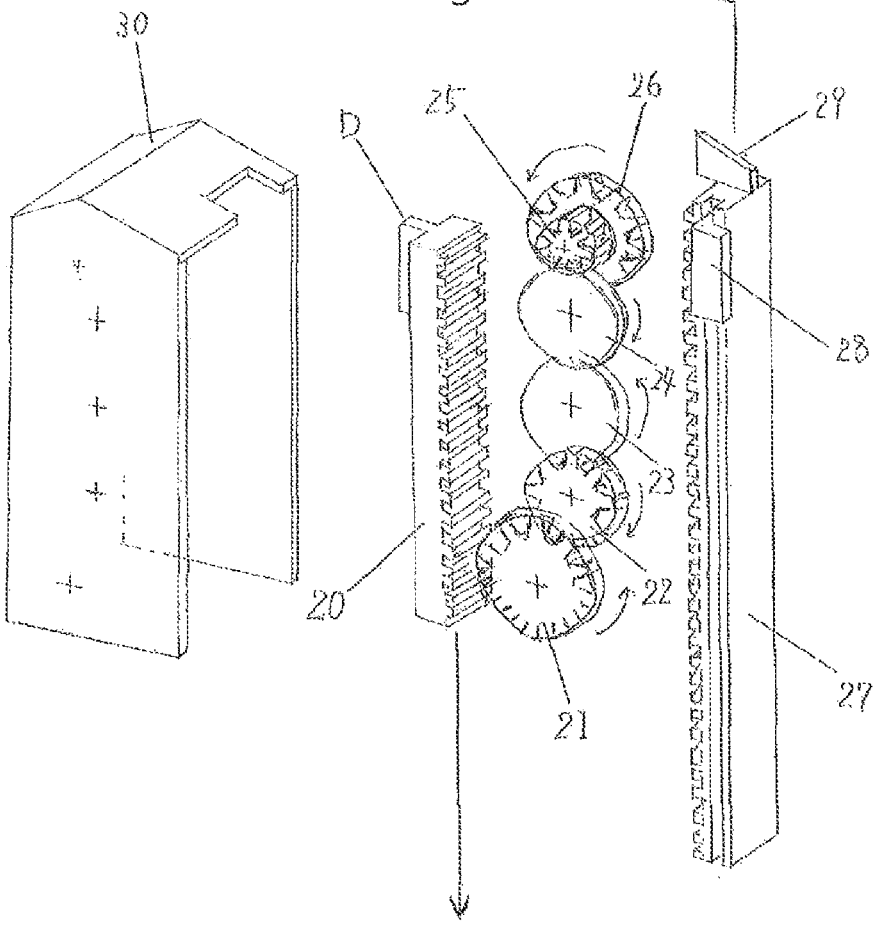

GOLF HOLE CUP WITH GOLF BALL EJECTION DEVICE

CROSS-REFERENCE TO RELATED APPLICATIONS

This application is a national stage of International Application No. PCT/JP2020/015289, filed Apr. 3, 2020, which claims the benefit of Japanese Application No. 2019-077316, filed Apr. 15, 2019, in the Japanese Patent Office, the disclosures of which are incorporated herein by reference.

TECHNICAL FIELD

The present invention relates to a golf hole cup with a golf ball ejection device that ejects a golf ball that has entered the golf hole cup to the ground in response to an operation of pushing down a flagstick, and restores the original position when a hand is released from the flagstick thereafter.

BACKGROUND ART

Since 2019, the rules of golf have been revised to allow golfers to putt without removing the flagstick. Unfortunately, this forces one to pick up the ball that has dropped in the cup without removing the flagstick, which is very difficult because the flagstick gets in the way. Such a difficult situation may lead to a player forcibly picking up the ball, which may result in his or her finger or the ball rubbing against the edge (turf) around the cup to impose a huge impact on the play thereafter. This has become a very serious issue these days. Patent Literature 1 and Patent Literature 2 are known as prior art documents related to the present invention.

CITATIONS LIST

Patent Literatures

Patent Literature 1: U.S. Pat. No. 1,402,026

Patent Literature 2: U.S. Patent Application Publication No. 2018/0207496

SUMMARY OF INVENTION

Technical Problems

An object of the invention according to the present application is to provide a technique enabling a ball that has dropped in the cup to be easily ejected to the ground without removing the flagstick.

Solutions to Problems

A golf hole cup with a golf ball ejection device can be used as a golf cup in a conventional manner with a flagstick removed, whereas also functions such that when the flagstick left inserted is held and pushed down by hand, the exerted force activates a drive unit to push a bottom plate part of the cup up to the ground so that a golf ball in the cup is ejected onto the ground, and when the hand is released thereafter, the bottom plate part returns to the original position. Thus, the object described above can be achieved.

Advantageous Effects of Invention

A golf hole cup with a golf ball ejection device can be used as a golf cup in a conventional manner with a flagstick removed, whereas also functions such that when the flagstick left inserted is simply held and pushed down by hand, a golf ball in the cup is ejected onto the ground, and when the hand is released thereafter, the bottom plate part returns to the original position. Thus, the edge (turf) around the cup would not be damaged. Furthermore, the cup is good for the health since it does not require a person such as an elderly to bend deeply to pick up the ball and hence does not impose burdens on his or her legs or waist.

The objects, features, aspects, and advantages of the present invention will become more apparent with the following detailed description and accompanying drawings.

BRIEF DESCRIPTION OF DRAWINGS

FIGS. 1A and 1B are transparent views illustrating a configuration of a golf hole cup with a golf ball ejection device of the present invention, in which FIG. 1A illustrates a state with a golf ball having dropped in the cup, and FIG. 1B illustrates a state with the golf ball ejected.

FIGS. 4A to 4C are perspective views illustrating an example of a configuration of parts of a drive unit with a gear configuration of the golf hole cup with a golf ball ejection device having the gear configuration according to the embodiment of the present invention, in which FIG. 4A illustrates a bottom plate part, FIG. 48 illustrates a cover box, and FIG. 4C illustrates a rack, a pinion, and gears.

FIGS. 5A to 5C are perspective views illustrating an example of a configuration of parts of a drive unit with a hydraulic configuration of a golf hole cup with a golf ball ejection device according to another embodiment of the present invention, in which FIG. 5A illustrates a bottom plate part, FIG. 5B illustrates a movable part and a transmission part, and FIG. 5C illustrates a piston, a connecting pipe, and a hydraulic cylinder.

FIGS. 6A and 6B are cross-sectional views illustrating a configuration of a golf hole cup with a golf ball ejection device with a reach extender configuration according to still another embodiment of the present invention, in which FIG. 6A illustrates a state with a golf ball has dropped in the cup, and FIG. 6B illustrates a state with the golf ball ejected.

DESCRIPTION OF EMBODIMENTS

A golf hole cup with a golf ball ejection device according to the invention of the present application includes a movable part B of a golf hole cup 2 into which a lower end portion A of a flagstick 1 is inserted, a guide part C that guides the movable part B upward and downward vertically, a transmission part D that transmits downward acting force from the movable part B, a drive unit E that converts the downward acting force into upward acting force, an elevation part F that is elevated upon receiving force from the drive unit E, a bottom plate part G that is tightly connected to and elevated with the elevation part F, and an elastic body H that exerts force to make the movable part B return to the original position, and functions such that when the flagstick 1 is pushed down while being left inserted in the golf hole cup 2, the bottom plate part G is elevated, and a golf ball 51 that has dropped in the cup can be pushed up to a level at or around the ground, and when a hand is released from the flagstick 1, the bottom plate part G returns to the original position due to the elastic body H.

Figure 1A:
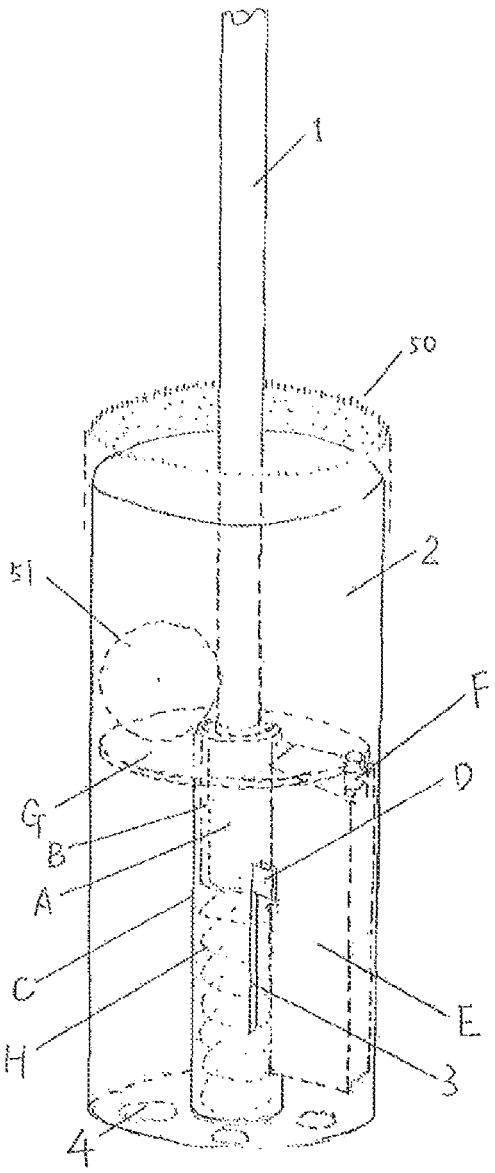
Figure 1B:
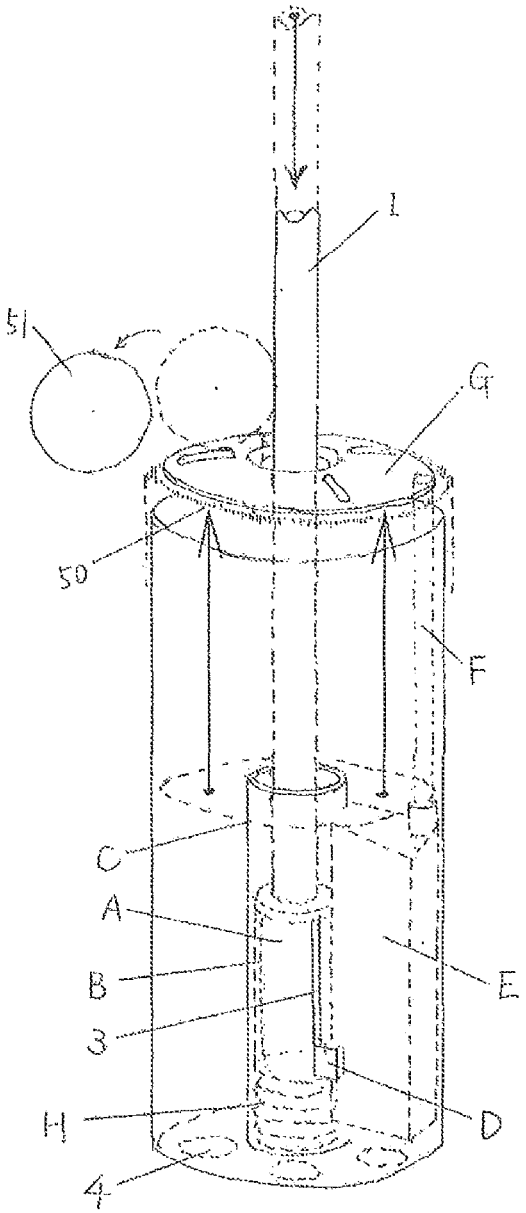

A configuration of a golf hole cup of the present invention will be described with reference to FIGS. 1A and 1B. The golf hole cup can be used in a conventional manner with a flagstick 1 removed, whereas has a function of enabling a golf ball 51 dropped in the cup to be ejected onto the ground with the flagstick 1 left inserted. First, a lower end portion A of the flagstick 1 is inserted into a movable part 8, and the flagstick 1 held by hand is pressed down by about 5 cm, while maintaining the inserted state. This results in the movable part B being vertically lowered about 5 cm in a guide part C. A transmission part D, which is tightly connected with the movable part B, is also lowered by about 5 cm. Then, a drive unit E converts the downward acting force received from the transmission part D into upward acting force. An elevation part F is elevated about 11 cm by receiving the upward force from the drive unit E. A bottom plate part G is at the depth of about 10 cm in a generally installed hole cup. Thus, the bottom plate part G tightly connected and moving upward together with the elevation part F pushes up the ball dropped in the cup, to a level slightly above the ground (turf surface). The bottom plate part G has an umbrella shaped cross section with a slope, whereby the golf ball 51 thus pushed up rolls down onto the ground (turf surface). Then, when the hand pushing down is slowly released, the movable part B is pushed up by restoring force of an elastic body H arranged under the movable part B. Thus, the flagstick 1 and the bottom plate part G return to their original positions.

In the above description, the flagstick 1 is lowered by about 5 cm, but the distance is not limited to 5 cm depending on the force applied by the drive unit E and the elastic body H. It suffices if the bottom plate part G is elevated to a level slightly above the ground (turf surface). The reason why the distance is described above to be about 5 cm is because that should be a reasonable distance easily achievable without requiring a large amount of force. If the distance is too large, the hole cup would have a long size to be difficult to be installed. On the other hand, if the distance is too short, the drive unit E is forced to perform the operation under a heavier load directly related to a higher risk of failure. Furthermore, the restoring force of the elastic body H increases, and thus the flagstick 1 requires a larger amount of force to be pressed down. All things considered, the distance needs to be carefully adjusted.

The golf hole cup according to the present invention is made of metal with a lower risk of rusting, but may also be made of resin. The guide part C has a tubular shape, but may be in a form of rods arranged around the guiding path. In other words, the part may be in any form as long as the movable part B can be guided upward and downward vertically without hindering the operation of the elastic body H, and the acting force can be transmitted from the movable part B to the drive unit E through the transmission part D without burden.

First Embodiment

Gear Configuration

A golf hole cup with a golf ball ejection device according to a first embodiment of the present invention illustrated as an example in FIG. 3 and FIGS. 4A to 4C has the drive unit E including: an inner rack connected to the transmission part D, an inner pinion interlocked with the inner rack, an outer pinion that is driven by the driving of the inner pinion via a gear, and an outer rack serving as the elevation part F interlocked with the outer pinion. In the first embodiment employing the gear configuration, an inner rack 20 tightly connected with the transmission part D is interlocked with the movable part B and moves downward by about 5 cm. The inner pinion 21 in contact with the inner rack 20 rotates at a ratio of 1.0. As a result, gears 22, 23, and 24 rotate as well as a small gear 25. The outer pinion 26, which is integrated with the small gear 25, rotates in the same direction as the inner pinion 21 at a ratio of 2.2. The outer rack 27, which is the elevation part F in contact with the outer pinion 26, moves up about 11 cm. An outer rack guide 28 is for making the outer rack 27 vertically movable. In addition, a cover box 30 functions to fix each of the pinions and each of the gears of the drive unit E, and also functions to make the drive unit E protect a gear section from rainwater and fine soil, to prevent a negative impact from being imposed on the gear section. Next, the outer rack 27 is elevated, so the bottom plate part G is pushed up to the ground by about 11 cm, resulting in the golf ball being ejected onto the ground (on the turf). Then, when the hand is released from the flagstick 1, the movable part B is pushed up by the restoring force of the elastic body H, whereby the bottom plate part G and the flagstick 1 return to the original positions through the procedure opposite to that described above. The range enabling the movement caused by the pushing is set to be about 5 cm, and thus a guiderail 3 guiding the transmission part D, provided to the guide part C is set to have a length not allowing the movement beyond the range.

Second Embodiment

Hydraulic Configuration

Figures 5A, 5B, 5C:
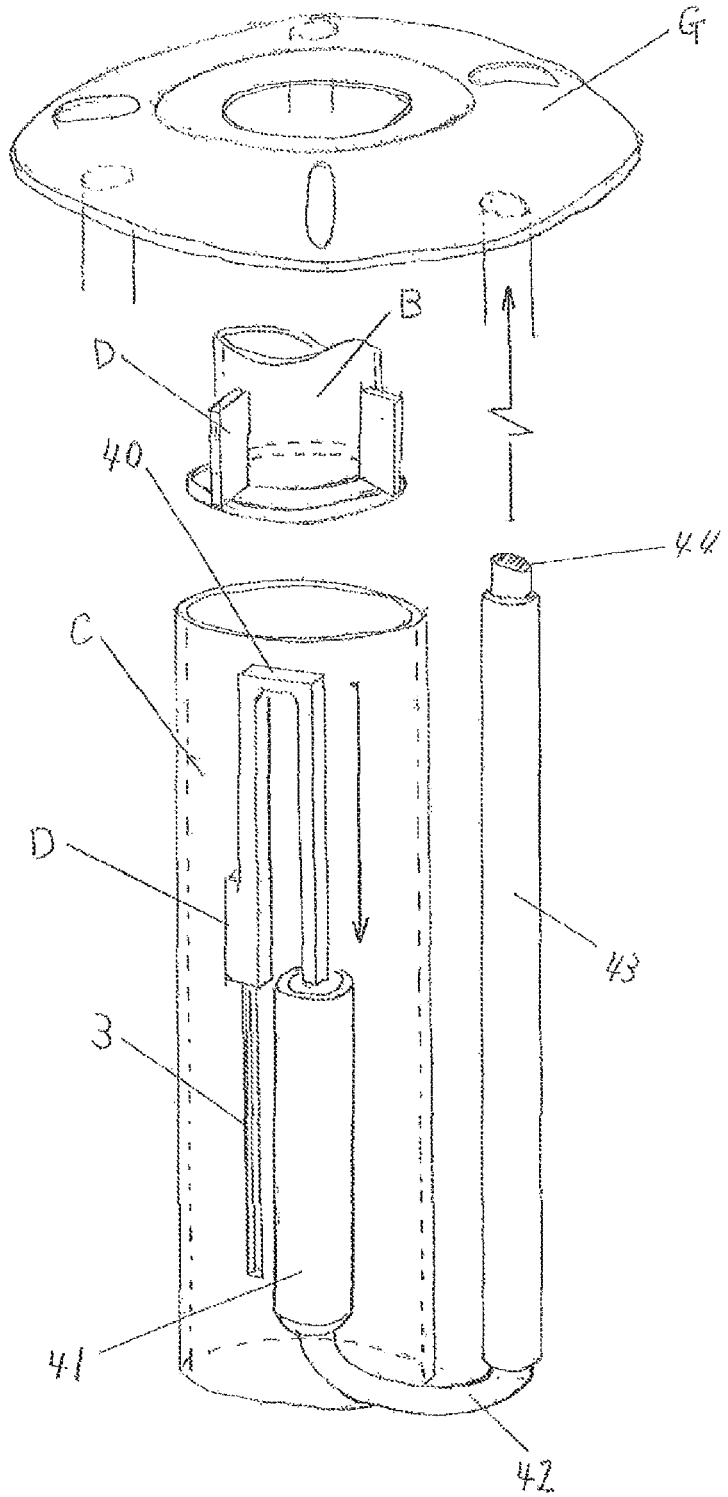

In a golf hole cup with a golf ball ejection device according to a second embodiment of the present invention illustrated as an example in FIGS. 5A to 5C, the drive unit E includes an inner piston connected to the transmission part D, an inner hydraulic cylinder on which the inner piston acts, an outer hydraulic cylinder connected to the inner hydraulic cylinder via a connecting pipe, and an outer piston serving as the elevation part F acting on the outer hydraulic cylinder. In the second embodiment employing a drive unit A with a hydraulic configuration, an inner piston 40 tightly connected to the transmission part D is interlocked with the movable part B to move downward by about 5 cm. An oil in an inner hydraulic cylinder 41 is compressed by the inner piston 40 and flows into an outer hydraulic cylinder 43 through a connecting pipe 42. This is implemented with the oil volume ratio between the inner hydraulic cylinder 41 and the outer hydraulic cylinder 43 being 1:2.2. Then, an outer piston 44 serving as the elevation part F is elevated by 11 cm, with the oil flowing into the outer hydraulic cylinder 43. When the outer piston 44 moves up, the bottom plate part G is pushed up to the ground by about 11 cm, whereby the golf ball is ejected onto the ground (onto the turf). Then, when the hand is released from the flagstick 1, the movable part B is pushed up by the restoring force of the elastic body H, whereby the bottom plate part G and the flagstick 1 return to the original positions through the procedure opposite to that described above. The range enabling the movement caused by the pushing is set to be about 5 cm, and thus a guiderail 3 guiding the transmission part D, provided to the guide part C is set to have a length not allowing the movement beyond the range.

Third Embodiment

Reach Extender Configuration

Figure 6A:
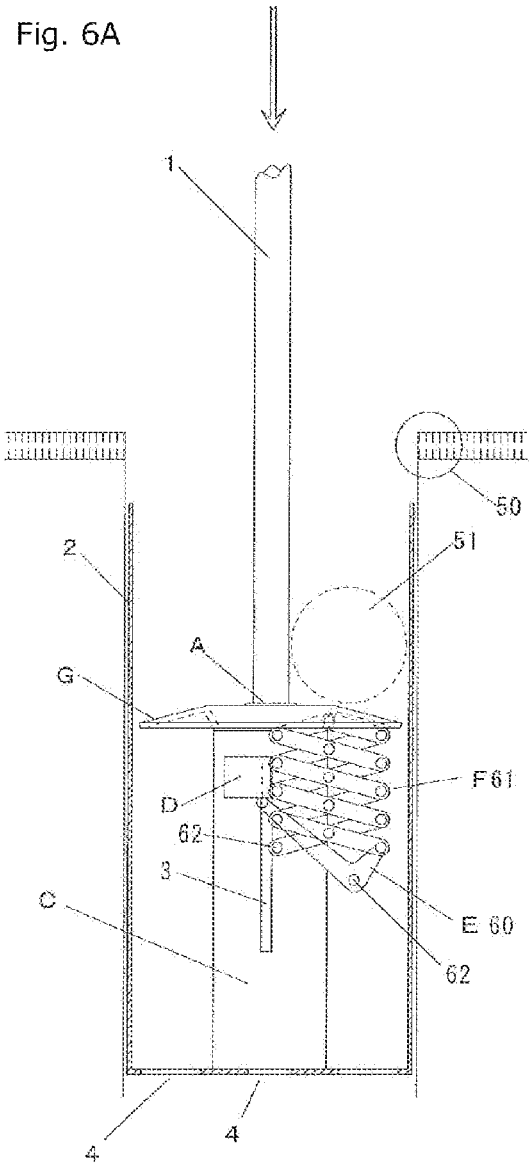
Figure 6B:
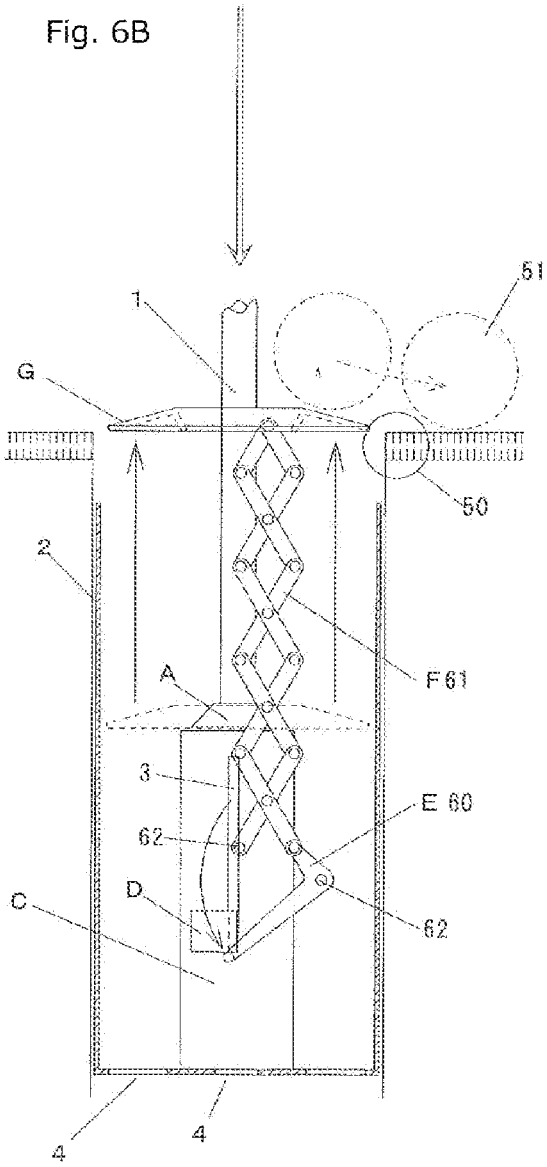
Figure 7:
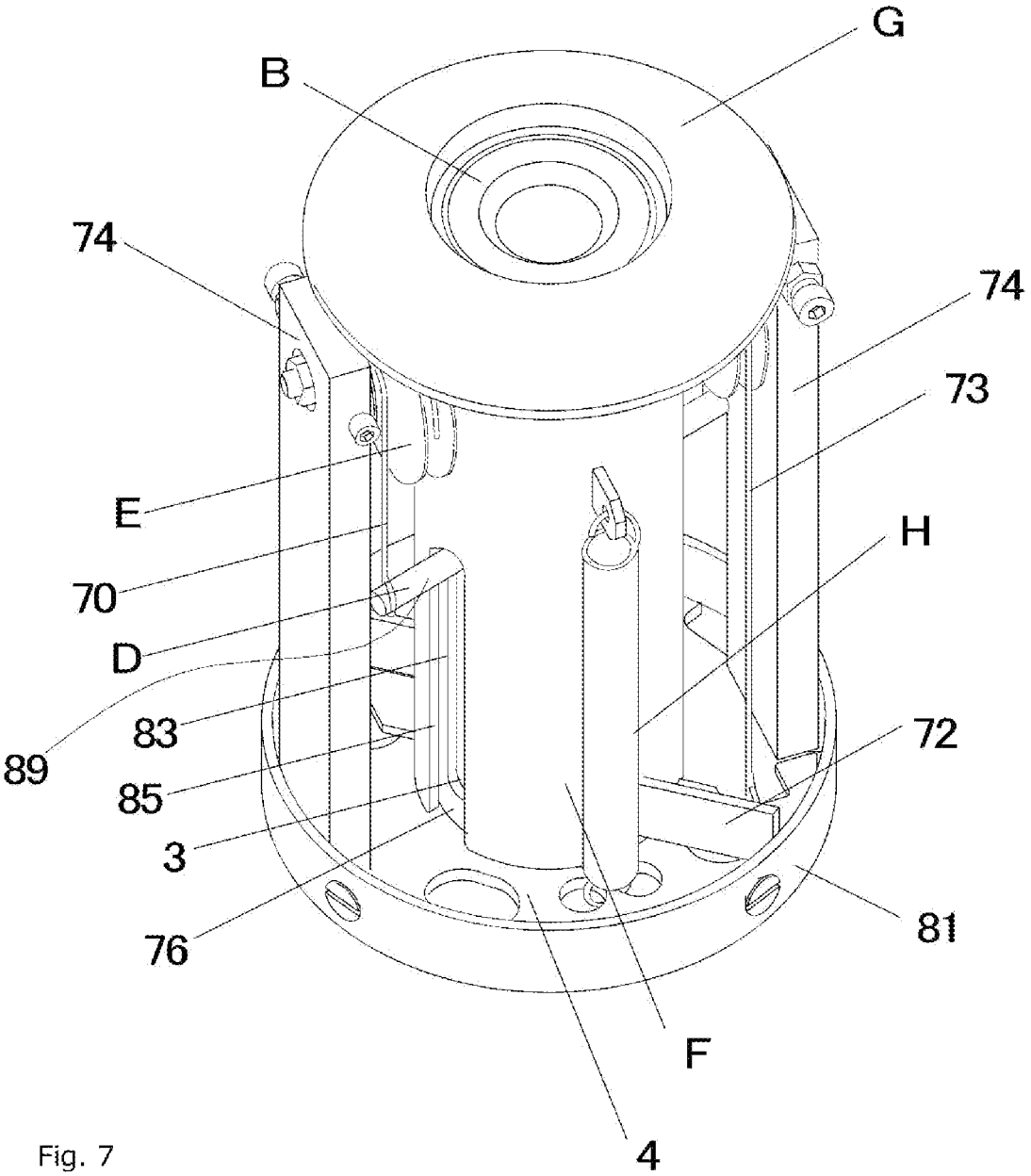
FIG. 7 is a perspective view illustrating an example of a configuration of a golf hole cup with a golf ball ejection device with a pulley configuration as yet another embodiment of the present invention, in a state before being driven.
Figure 8:
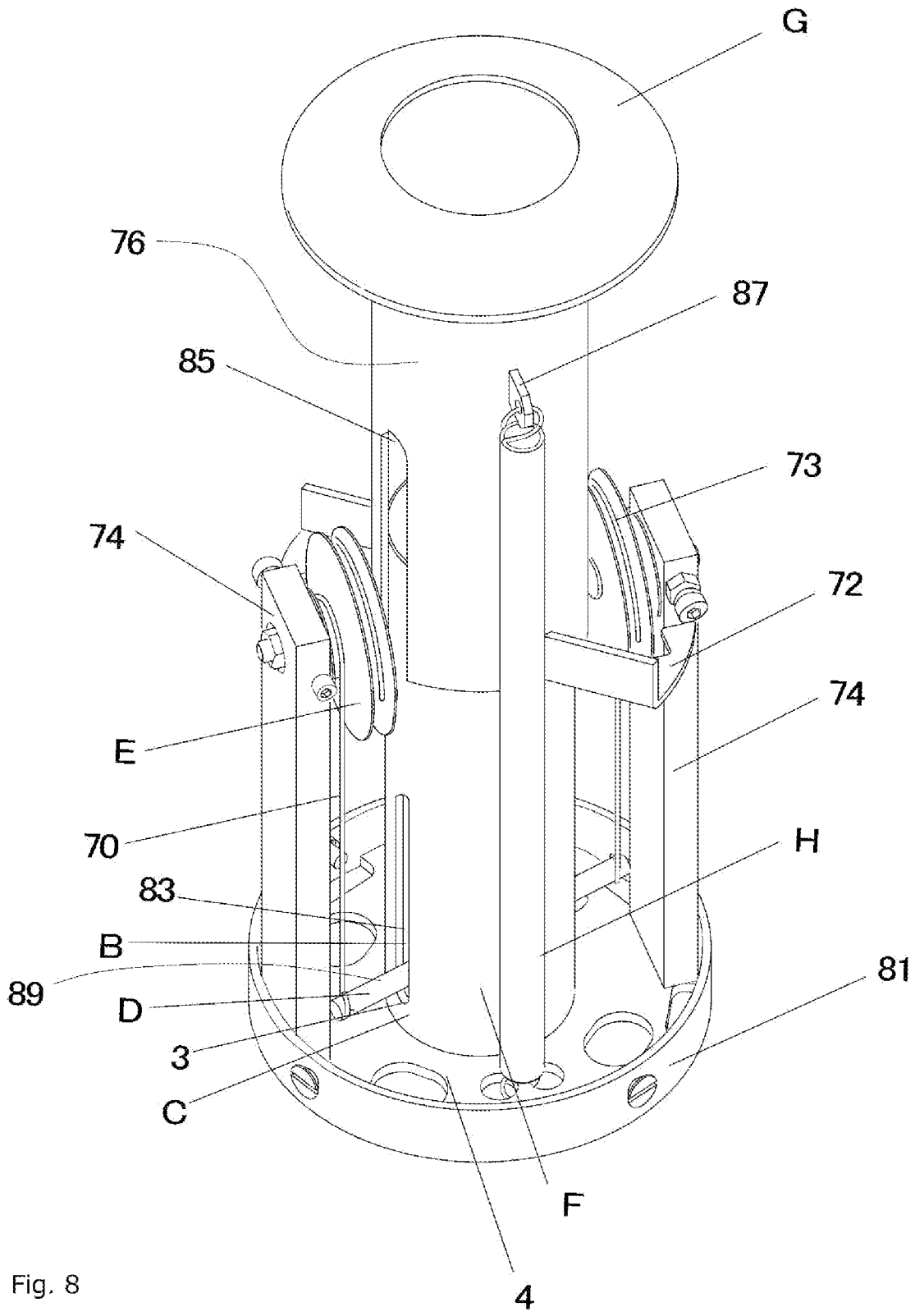
FIG. 8 is a perspective view illustrating an example of a state in which the configuration of the embodiment illustrated as an example in FIG. 7 is driven to eject a golf ball.
Figure 9:
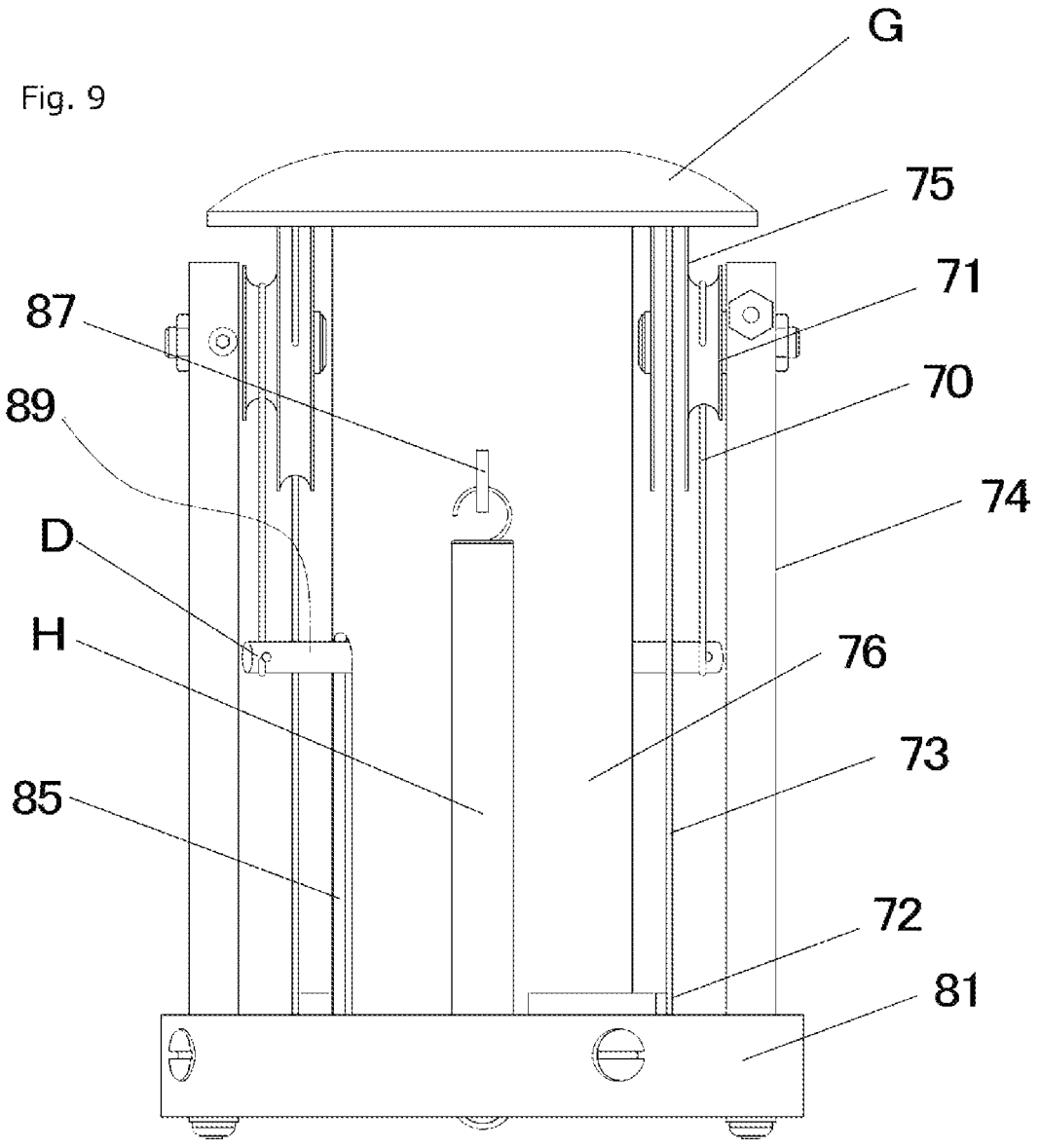
FIG. 9 is a front view illustrating an example of a state before driving the configuration of the embodiment illustrated as an example in FIG. 7.
Figure 10:
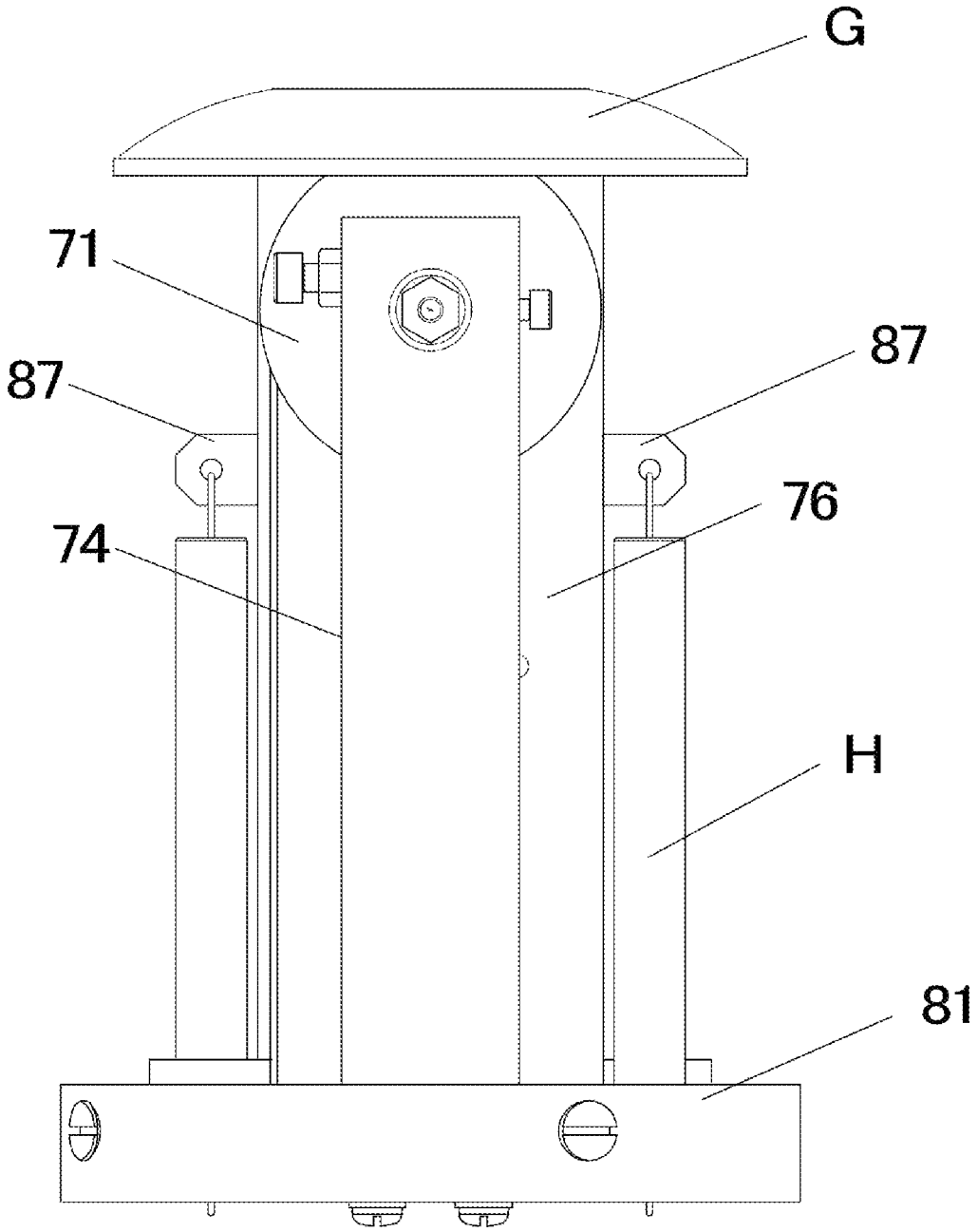
FIG. 10 is a side view illustrating an example of a state before driving the configuration of the embodiment illustrated as an example in FIG. 7.
Figure 11:
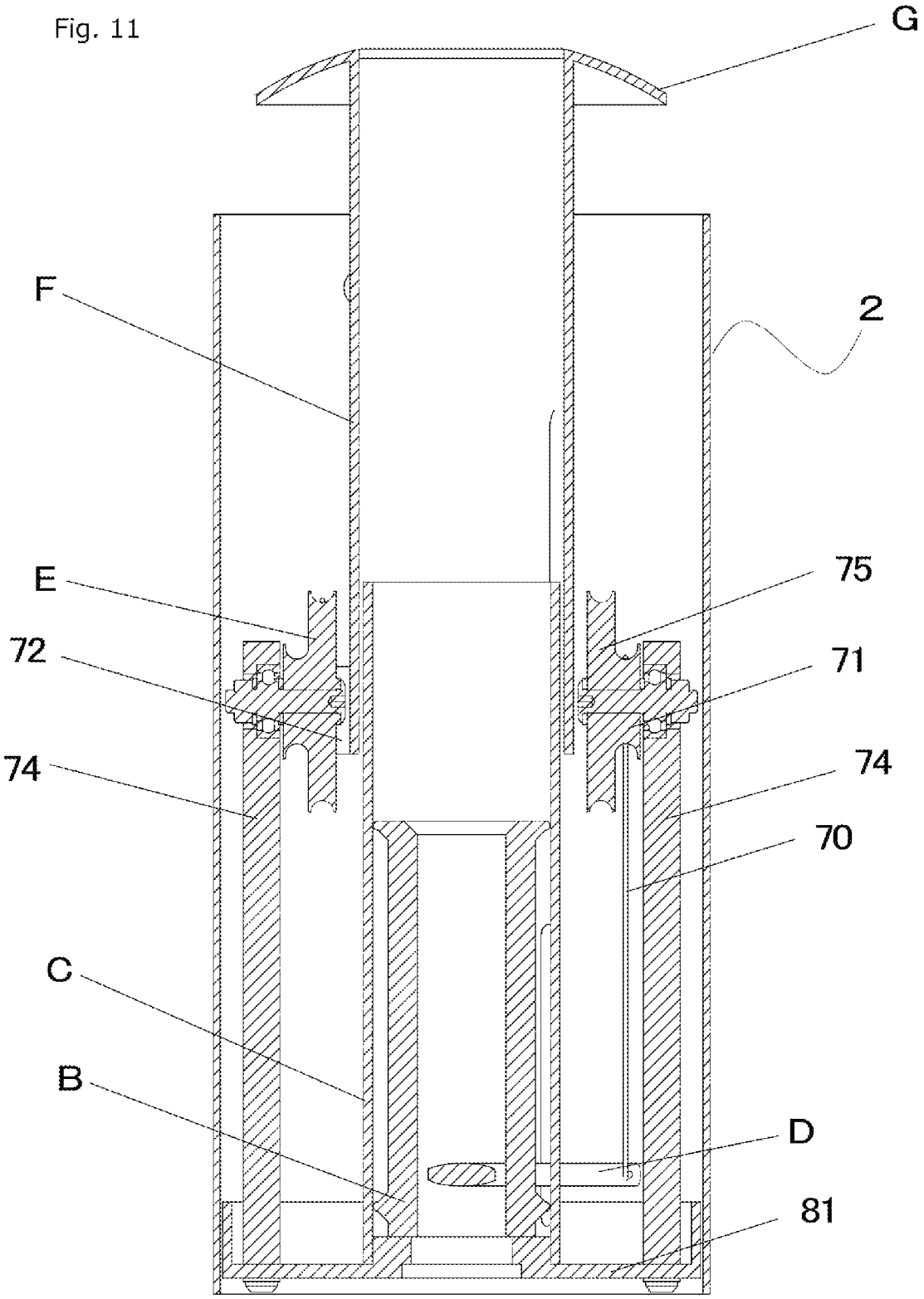
FIG. 11 is a vertical cross-sectional view illustrating an example of a state in which the configuration of the embodiment illustrated as an example in FIG. 7 is driven to eject a golf ball.
Figure 12:
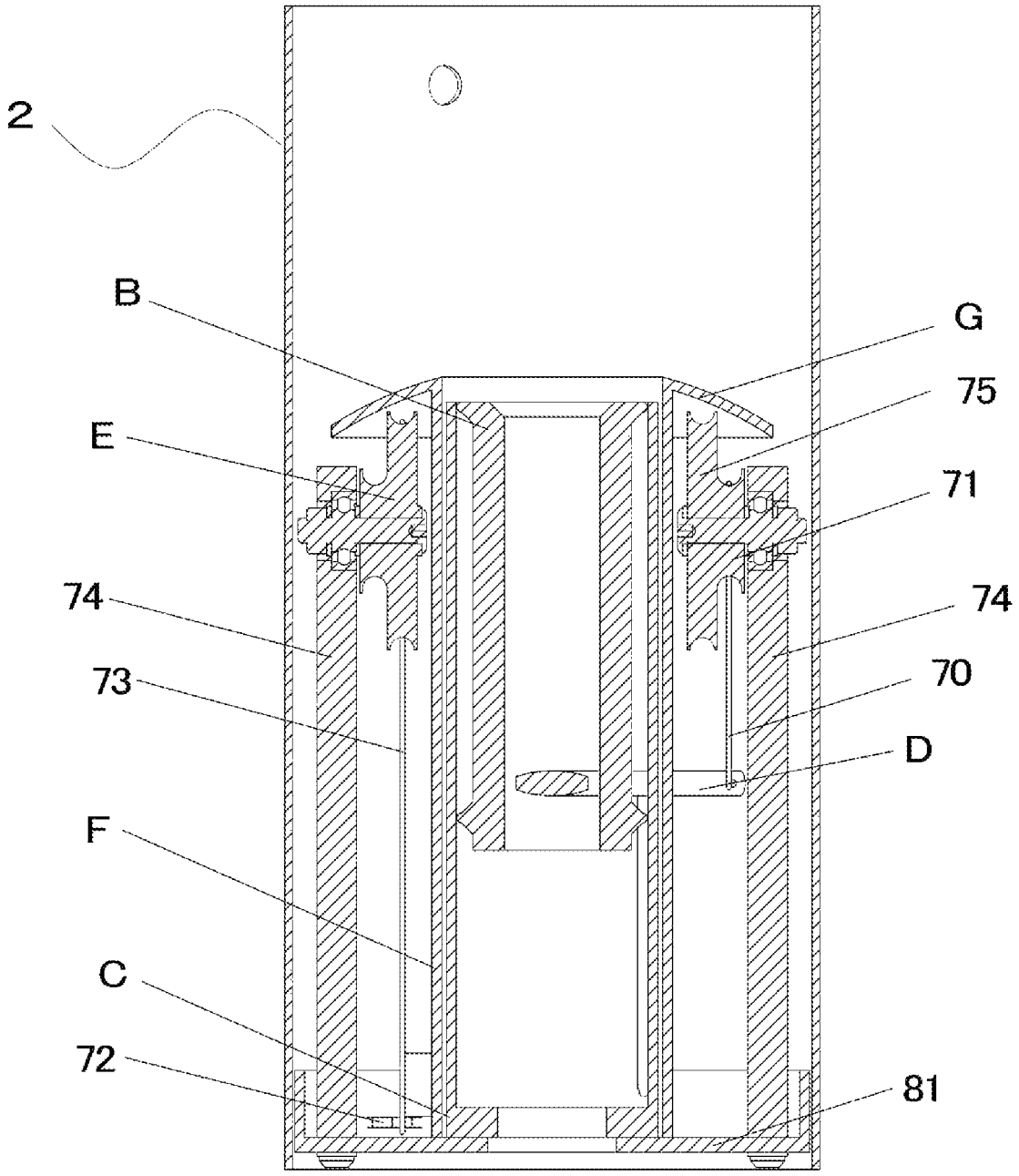
FIG. 12 is a vertical cross-sectional view illustrating an example of a state before driving the configuration of the embodiment illustrated as an example in FIG. 7.

In a golf hole cup with a golf ball ejection device according to a third embodiment of the present invention illustrated as an example in FIGS. 6A and 6B, the drive unit E includes a lever driven by the action of the transmission part D and a reach extender serving as the elevation part F that moves up by the driving of the lever. In the third embodiment employing drive units A with reach extender configuration, the transmission part D is interlocked with the movable part B to move downward by about 5 cm. The resultant force turns a lever 60 of the drive unit E. A reach extender 61 serving as the elevation part F that has been contracted, expands when the lever 60 turns. The force of the expansion pushes up the bottom plate part G to the ground by about 11 cm, whereby the golf ball is ejected onto the ground (onto the turf). Then, when the hand is released from the flagstick 1, the movable part B is pushed up by the restoring force of the elastic body H, whereby the bottom plate part G and the flagstick 1 return to the original positions through the procedure opposite to that described above. The range enabling the movement caused by the pushing is set to be about 5 cm, and thus a guiderail 3 guiding the transmission part D, provided to the guide part C is set to have a length not allowing the movement beyond the range.

Figure 2:
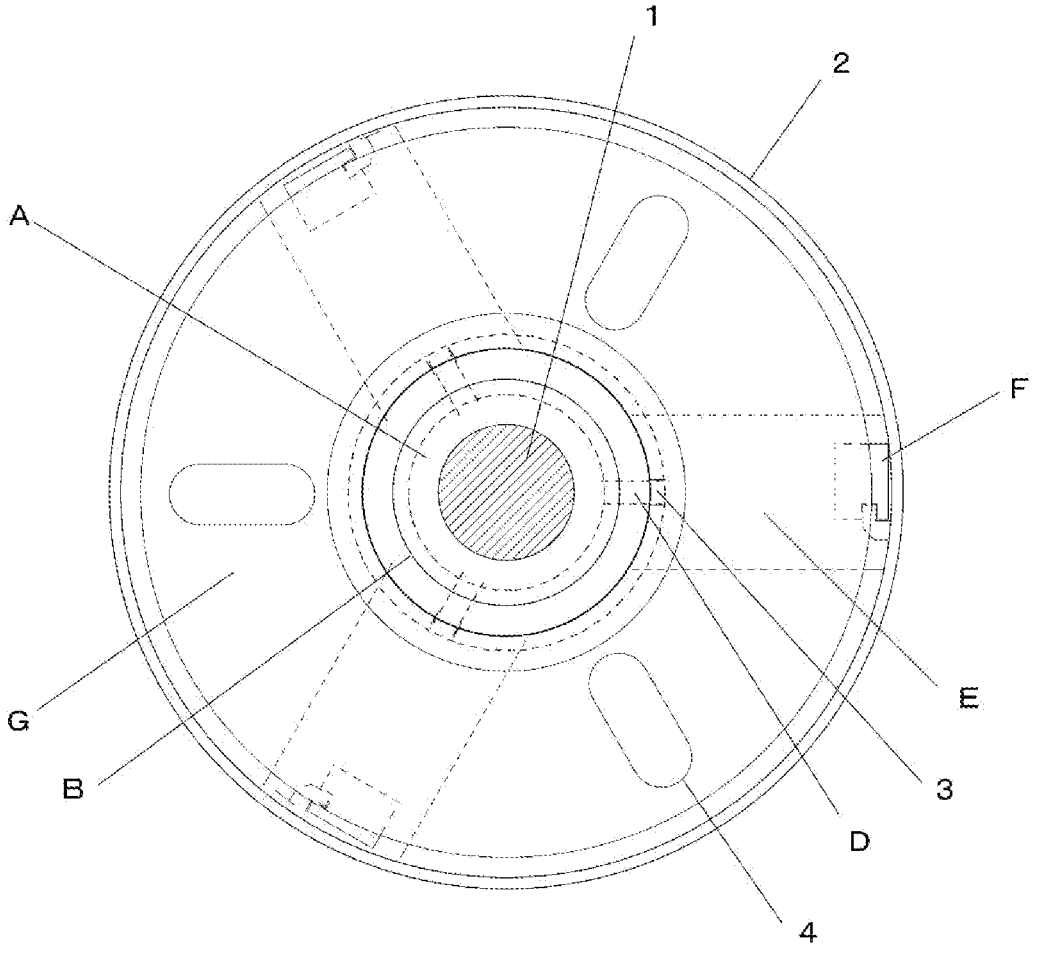
FIG. 2 is a plan view of the golf hole cup with a golf ball ejection device of the present invention.
Figure 3:
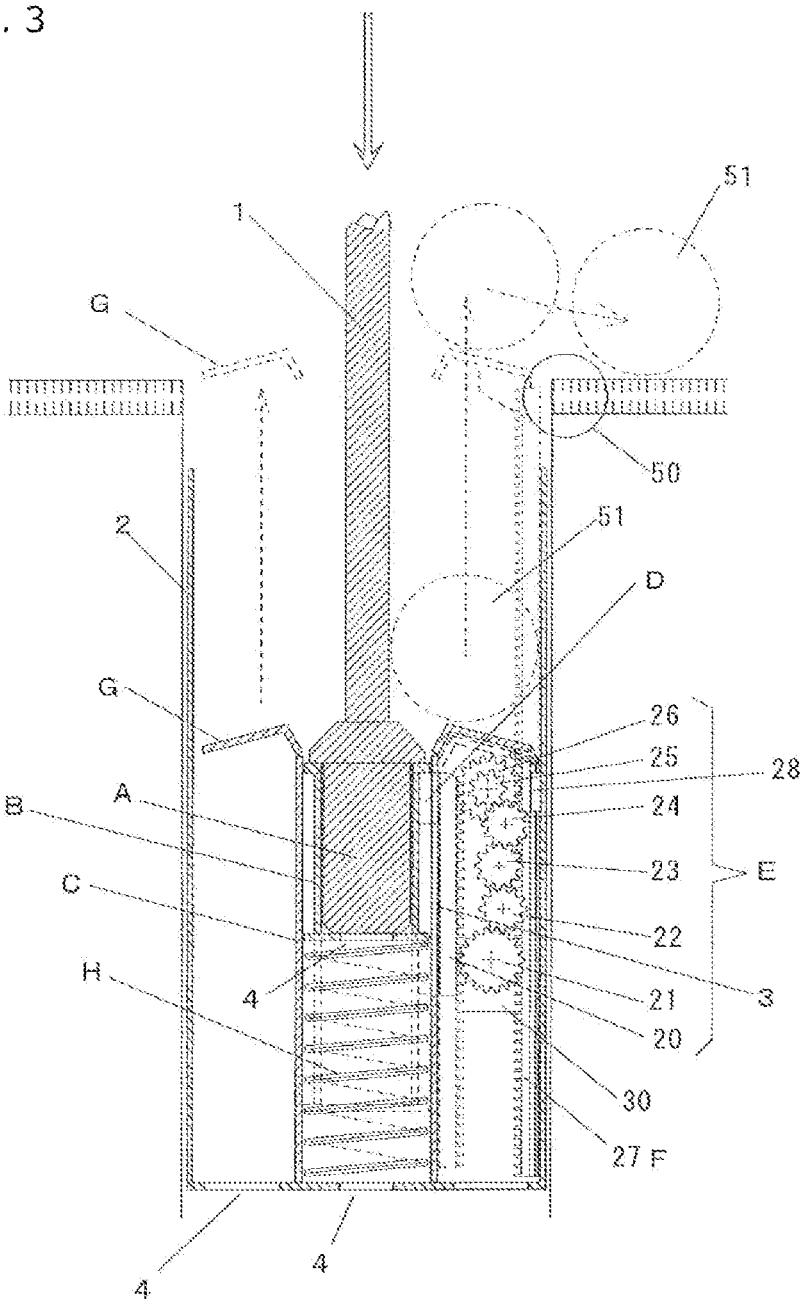
FIG. 3 is a cross-sectional view of a golf hole cup with a golf ball ejection device having a gear configuration according to an embodiment of the present invention.

The drive units A are all in planer arrangement at three positions as illustrated in FIG. 2, so that the bottom plate part D can be elevated in a balanced manner. The number of the positions may be two, as long as the balance can be achieved.

Fourth Embodiment

Pulley Configuration

FIGS. 7 to 12 illustrate an example of a golf hole cup with a golf ball ejection device according to a fourth embodiment of the present invention. In the illustrated example, a base 81 is disposed at the bottom of the inner cavity of a tubular cup 2. In the illustrated example, the base 81 is fixed to the lower end portion of the cup 2 by screwing. FIGS. 7 to 10 illustrate the heads of the screws screwed into the outer circumferential wall of the base 81. The guide part C having a tubular shape stands on the base 81. The inner cavity of the guide part C contains the movable part B movable upward and downward while being guided by the guide part C. In the illustrated example, the movable part B also has a tubular shape, and has an inner cavity that can receive the lower end portion A of the flagstick 1. The transmission part D is connected to the movable part B. In the illustrated example, the transmission part D is a rod-shaped body that is disposed through the tubular movable part B in the radial direction. In the illustrated example, the lower end portion A of the flagstick 1 received in the inner cavity of the tubular movable part B stops when a bulging part (see FIG. 3) bulging outward in the radial direction of the lower end portion A comes into contact with the upper end edge of the movable part B. A slit 83 through which the rod-shaped transmission part D is slidably inserted extends vertically in the tubular guide part C so that the transmission part D can move upward and downward together with the movable part B.

In the illustrated example, a tubular elevation part main body 76, which is a main body part of the elevation part F and is movable upward and downward while being guided by the guide part C, is arranged on the outer side of the tubular guide part C in the radial direction. The tubular elevation part main body 76 also has a slit 85 extending vertically so as to avoid interference with the rod-shaped transmission part D. The bottom plate part G is connected to the top of the elevation part main body 76.

In the illustrated example, a pair of pulley supports 74 further stands on the base 81. The pair of pulley supports 74 is disposed at positions on both sides of the guide part C, that is, at positions that are on the outer side of the guide part C in the radial direction and are symmetrical about the center axis of the guide part C. Pulleys 71 and 75 that are concentric and have different diameters are rotatably supported on the respective pulley supports 74. The pulleys 71 and 75 that are concentric and have different diameters include a smaller pulley 71 which is a pulley with a relatively small diameter and a larger pulley 75 with a relatively large diameter. The smaller pulley 71 and the larger pulley 75 have a common rotation axis and are connected to each other so as to rotate together. The smaller pulley 71 and the larger pulley 75 may be connected to each other via a rotation shaft, or may be connected to each other via any other member. For example, they may be connected to each other by being screwed to each other. Alternatively, they may be connected to each other by an adhesive, welding, or the like. Furthermore, as in the illustrated example, the smaller pulley 71 and the larger pulley 75 may be integrally processed or molded. Thus, the term "pulleys that are concentric and have different diameters" is used in such a broad sense.

A wire-like body 70 has a base end connected to the smaller pulley 71, and the wire-like body 70 is wound around the smaller pulley 71 with this base end serving as the starting point of winding. The wire-like body 70 has the distal end connected to an end portion of the transmission part D. The end portion of the transmission part D corresponds to a protrusion portion 89 protruding outward in the radial direction from the side wall of the movable part (B). Thus, the distal end portions of a pair of wire-like bodies 70 are connected to both ends of the transmission part D, that is, a pair of protrusion portions 89. A wire-like body 73 has a base end connected to the larger pulley 75, and the wire-like body 73 is wound around the larger pulley 75 with this base end serving as the starting point of winding. The wire-like body 73 is wound in the direction opposite to that of the wire-like body 70. The distal end of the wire-like body 73 is connected to a connection part 72 that protrudes outward in the radial direction from the side wall of the elevation part main body 76. The connection part 72 is a part of the elevation part F. The pair of connection parts 72 are disposed at positions symmetrical relative to the center axis of the elevation part main body 76, and the distal ends of the pair of wire-like bodies 73 are connected thereto. The position of the distal end of the wire-like body 70 hanging from the smaller pulley 71 and the position of the distal end of the wire-like body 73 hanging from the larger pulley 75 are different from each other in the position around the center axis of the guide part C, that is, the position along the circumference. Thus, the positions of both end portions of the transmission part D, that is, the pair of protrusion portions 89 and the positions of the pair of connection parts 72 are different along the circumference. In the illustrated example, the wire-like bodies 70 and 73 are metal wires.

In the illustrated example, the elastic body H is connected to the base 81 and the elevation part F. In the illustrated example, the elastic body H is a tension coil spring, has the lower end connected to the base 81, and has the upper end connected to the connection part 87 protruding radially outward from the elevation part main body 76. The connection part 87 is a part of the elevation part F. Thus, the elevation part F is biased by the elastic restoring force of the elastic body H to be lowered to the original position from the elevated position. In the illustrated example, a pair of elastic bodies H are arranged at positions symmetrical relative to the center axis of the elevation part F.

The golf hole cup with the golf ball ejection device of the illustrated example, having the configuration as described above, function as follows. When the flagstick 1 is pushed down by, for example, 5 cm with the flagstick 1 left inserted in the movable part B, the transmission part D connected to the movable part B is lowered by 5 cm. As a result, the wire-like body 70 connected to the transmission part D is pulled down, and the smaller pulley 71 of the drive unit E connected to the wire-like body 70 rotates. The larger pulley 75 is connected to the smaller pulley 71, and thus the larger pulley 75 also rotates. When the wire-like body 73 connected to the larger pulley 75 is wound up by the rotating larger pulley 75, the elevation part F connected to the lower end portion of the wire-like body 73 via the connection part 72 and the bottom plate part G connected to the top portion of the elevation part F are elevated by 12 cm for example. As a result, the golf ball is ejected out of the hole.

When the hand releases the flagstick 1 after the golf ball is ejected, the elevation part F and the bottom plate part G are pulled down by the elastic restoring force of the elastic body H. As a result, the wire-like body 73 connected to the connection part 72 is pulled down, and the larger pulley 75 and the smaller pulley 71 rotate. As a result, the wire-like body 70 is wound up, whereby the transmission part D, the movable part B, and the flagstick 1 are elevated to their original positions.

FIGS. 7 to 12 illustrate, as the elastic body H, an elastic body, such as a tension coil spring, connected to the elevation part F and exerting tension as the elastic restoring force. Alternatively, as illustrated in FIG. 1 as an example, an elastic body, such as a compression coil spring, disposed at the bottom of the movable part B and exerting resilience as the elastic restoring force may be used as the elastic body H. Also in this case, when the movable part B is pushed up to the original position by the elastic body H, the wire-like body 73 wound around the larger pulley 75 is drawn out by the rotation of the larger pulley 75, resulting in the elevation part F and the bottom plate part G being lowered to their original positions with their own weight. Generally, the elastic body H may be any member that biases, with the elastic restoring force, a movable portion of any of the movable part B, the transmission part D, the drive unit E, the elevation part F, and the bottom plate part G, to make the lowered movable part B and the elevation part F return to the original positions. This is because the movable portions of the elements from the movable part B to the bottom plate part G are coupled to each other in an interlocked manner, and this mechanism is apparent to those skilled in the art by only referring to the description in the first to the third embodiments in which the elastic body H biases the movable part B.

Furthermore, as the wire-like bodies 70 and 73, wire-like bodies other than metal wires such as, for example, ropes, threads, or chains may be used. Generally, the wire-like bodies 70 and 73 may be any member that can be bent or curved smoothly, and may be, for example, a strip-shaped elongated body. Thus, the term "wire-like body" is used in such a broad sense.

The elastic body H of the present invention is a coil spring, whereas may also be a leaf spring or a rubber product.

The elevated bottom plate part G is donut-shaped in plan view, and has an umbrella-shaped cross section with a slope. Thus, the elevation thereof to a level slightly above the ground (turf surface) results in golf ball rolling onto the ground (onto the turf). Thus, the ball can be ejected onto the ground with one-handed operation only and without damaging a portion around the edge of the cup (turf). Furthermore, with the material of the bottom plate part G being metal, the sound of the golf ball dropping in the cup will be the same as that in a conventional one.

Considering the risk of rainwater or fine soil entering, the outer radius of the bottom plate part G is set to be about 5 mm smaller than that of cup 2, so that a gap is formed therebetween. Furthermore, several drain holes are provided. Drain holes 17 are provided at the bottom of the movable part B into which the flagstick 1 is inserted and the bottom of the guide part C, as well as the bottom of the cup 2, whereby the foreign object that has entered is ejected into the ground.

The golf hole cup 2 of the present invention has a size that allows the flagstick 1 and the lower end portion A of the flagstick 1 that are generally available on the market to be used, and the outer diameter of the cup is the same as those of conventional products. Thus, the golf hole cup 2 can easily be installed using a hole cutter that is also generally available on the market.

The golf hole cup of the present invention is of a manually operated type with a simple structure, and thus features excellent durability and is less likely to fail. The golf hole cup is described above as a product made of metal with a lower risk of rusting, but may be made of resin as long as the functions can be provided. The present invention enables mass-production at low cost.

This application is based on Japanese Patent Application No. 2019-77316 filed in Japan on Apr. 15, 2019, the entire contents of which are incorporated herein by reference. Japanese Patent Application No. 2019-77316 has already been patented as Japanese Patent No. 6604563, and the patent right has already been owned by the applicant of the present application through the procedure of transfer filed with the Japan Patent Office.

The above description of the specific embodiments of the present invention is presented as merely an example. They are not intended to be exhaustive or to limit the present invention strictly to the embodiments descried therein. It is apparent to those skilled in the art that numerous modifications and changes can be made based on the above description.

REFERENCE SIGNS LIST

1 Flagstick
A Lower end portion of flagstick (socket at the bottom of flagstick 1)
B Movable part (the movable part in which the lower end portion A of the flagstick 1 is inserted)
C Guide part (the part that guides the movable part B vertically up and down)
D Transmission part (the part that is tightly connected to the movable part B and transmits the downward force to the drive unit E)
E Drive unit (the part that converts the downward force into upward force and transmits the force to elevation part F)
F Elevation part (the part that is elevated upon receiving the upward force from the drive unit E)
G Bottom plate part (donut-shaped with an umbrella-shaped inclined surface)
H Elastic body
2 Golf hole cup
3 Guide rail that limits the vertically movable range of the transmission part D
4 Drain hole
20 Inner rack
21 Inner pinion
22 Gear
23 Gear
24 Gear
25 Small gear
26 Outer pinion
27 Outer rack
28 Outer rack guide
29 Bottom plate tight connector
30 Cover box
40 Inner piston
41 Inner hydraulic cylinder
42 Connecting pipe
43 Outer hydraulic cylinder
44 Outer piston
60 Lever
61 Reach extender part
62 Support point (fixed point rod)
50 Around the edge of the golf hole cup (turf)
51 Golf ball
70 wire-like body (first wire-like body)
71 Smaller pulley
72 Connection part
73 wire-like body (second wire-like body)
74 Pulley support
75 Larger pulley
76 Elevation part main body
81 Base
83 Slit
85 Slit
87 Connection part
89 Protrusion portion

The invention claimed is:

1. A golf hole cup with a golf ball ejection device comprising:
a golf hole cup;
a movable part accommodated in the golf hole cup, the movable part allowing a lower end portion of a golf flagstick to be inserted in and removed from the movable part, and the movable part being movable upward and downward with the flagstick left inserted in the movable part;
a guide part that guides the movable part vertically;
an elastic body that is provided at a bottom of the movable part, and exerts force to make the movable part that has been pushed down in the guide part return to an original position of the movable part before having been pushed down;
a drive unit;
a transmission part that is connected to the movable part and transmits downward acting force to the drive unit; wherein
the drive unit converts the downward acting force into upward acting force,
the golf hole cup with a golf ball ejection device further comprising:
an elevation part that is elevated upon receiving force from the drive unit; and
a bottom plate part that is connected to and is elevated with the elevation part, and
the golf hole cup with a golf ball ejection device enables, in putting on a putting green, a golf ball to drop in the cup with the flagstick removed, and functions such that when the golf ball drops in the cup with the flagstick left inserted, the flagstick is allowed to be held and pushed down by hand, making the movable part pushed downward, leading to elevation of the bottom plate part due to an action of the drive unit, resulting in the golf ball having dropped in the cup pushed up to a level at or around a ground to be ejected, and when the hand is afterward released from the flagstick, the movable part is pushed up by resilience of the elastic body, making the flagstick and the bottom plate part return to original positions of the flagstick and the bottom plate part before the flagstick having been pushed down.

2. The golf hole cup with a golf ball ejection device according to claim 1, wherein
the drive unit includes
an inner rack connected to the transmission part,
an inner pinion that is interlocked with the inner rack,
an outer pinion that is driven by driving of the inner pinion via a gear, and
an outer rack that is interlocked with the outer pinion and serves as the elevation part.

3. The golf hole cup with a golf ball ejection device according to claim 1, wherein
the drive unit includes
an inner piston connected to the transmission part,
an inner hydraulic cylinder on which the inner piston acts,
an outer hydraulic cylinder connected to the inner hydraulic cylinder via a connecting pipe, and
an outer piston that acts on the outer hydraulic cylinder and serves as the elevation part.

4. The golf hole cup with a golf ball ejection device according to claim 1, wherein
the drive unit includes
a lever that is driven by action of the transmission part, and
a reach extender that is elevated by driving of the lever and serves as the elevation part.

5. The golf hole cup with a golf ball ejection device according to claim 1, wherein the elastic body is formed of a coil spring, a leaf spring, or a rubber product.

6. The golf hole cup with a golf ball ejection device according to claim 1, wherein the bottom plate part has a donut shape in plan view, has an umbrella shape with a slope in vertical cross-sectional view, and has drain holes at a plurality of portions.

7. A golf hole cup with a golf ball ejection device comprising:

a golf hole cup;

a movable part accommodated in the golf hole cup, the movable part allowing a lower end portion of a golf flagstick to be inserted in and removed from the movable part, and the movable part being movable upward and downward with the flagstick left inserted in the movable part;

a guide part that guides the movable part vertically;

a drive unit;

a transmission part that is connected to the movable part and transmits downward acting force to the drive unit; wherein the drive unit converts the downward acting force into upward acting force, the golf hole cup with a golf ball ejection device further comprising:

an elevation part that is elevated upon receiving force from the drive unit;

a bottom plate part that is connected to and is elevated with the elevation part; and an elastic body that biases, with elastic restoring force, a movable portion of any of the movable part, the transmission part, the drive unit, the elevation part and the bottom plate part, to make the movable part that has been lowered and the elevation part that has been elevated return to original positions of the movable part and the elevation part before the movable part having been lowered and the elevation part having been elevated, and the golf hole cup with a golf ball ejection device enables, in putting on a putting green, a golf ball to drop in the cup with the flagstick removed, and functions such that when the golf ball drops in the cup with the flagstick left inserted, the flagstick is allowed to be held and pushed down by hand, making the movable part pushed downward, leading to elevation of the bottom plate part due to an action of the drive unit, resulting in the golf ball having dropped in the cup pushed up to a level at or around a ground to be ejected, and when the hand is afterward released from the flagstick, the elastic restoring force of the elastic body makes the movable part, the elevation part, the flagstick, and the bottom plate part return to original positions of the movable part, the elevation part, the flagstick and the bottom plate part before the flagstick having been pushed down.

8. The golf hole cup with a golf ball ejection device according to claim 7, wherein the drive unit includes pulleys that are concentric and have different diameters, including a smaller pulley having a relatively small diameter and a larger pulley having a relatively large diameter that have a common rotation axis and are coupled to each other to rotate together, a pulley support that rotatably supports the pulleys, a first wire-like body that has a distal end connected to the transmission part, has a base end connected to the smaller pulley, and is wound around the smaller pulley, a second wire-like body that has a distal end connected to the elevation part, has a base end connected to the larger pulley, and is wound around the larger pulley in a direction opposite to a direction of the first wire-like body.

9. The golf hole cup with a golf ball ejection device according to claim 8 further comprising a base, wherein the guide part has a tubular shape and stands on the base, the movable part has a tubular shape and is accommodated in an inner cavity of the guide part to be movable upward and downward while being guided by the guide part, and the movable part has an inner cavity capable of receiving the lower end portion of the flagstick.

10. The golf hole cup with a golf ball ejection device according to claim 9, wherein the transmission part includes a protrusion portion that protrudes outward in a radial direction from the movable part, the distal end of the first wire-like body is connected to the protrusion portion, and the guide part includes a slit into which the protrusion portion is inserted to be slidable upward and downward, the slit extending vertically.

11. The golf hole cup with a golf ball ejection device according to claim 10, wherein the elevation part includes a tubular elevation part main body, the elevation part main body is disposed on an outer side of the guide part in the radial direction to be movable upward and downward while being guided by the guide part, and the elevation part main body includes another slit into which the protrusion portion is inserted to be slidable upward and downward, the slit extending vertically.

* * * * *